US006595443B2

(12) United States Patent
Ottergren

(10) Patent No.: US 6,595,443 B2
(45) Date of Patent: Jul. 22, 2003

(54) METHOD AND DEVICE FOR CRUSHING MATERIAL IN A CRUSHING PLANT USING MULTISTEP CRUSHING

(75) Inventor: Christian Ottergren, Malmö (SE)

(73) Assignee: Sandvik AB, Svedala (SE)

( * ) Notice: Subject to any disclaimer, the term of this patent is extended or adjusted under 35 U.S.C. 154(b) by 0 days.

(21) Appl. No.: 10/010,913

(22) Filed: Dec. 6, 2001

(65) Prior Publication Data

US 2002/0043578 A1 Apr. 18, 2002

Related U.S. Application Data

(63) Continuation of application No. PCT/SE00/01231, filed on Jun. 14, 2000.

(30) Foreign Application Priority Data

Jun. 14, 1999 (SE) ..... 9902223

(51) Int. Cl.[7] ..... B02C 25/00

(52) U.S. Cl. ..... 241/29; 241/30; 241/37; 241/152.1

(58) Field of Search ..... 241/37, 30, 152.2, 241/152.1, 29

(56) References Cited

U.S. PATENT DOCUMENTS 4,179,074 A 12/1979 Flavel
4,281,800 A 8/1981 Flavel

*Primary Examiner*—Mark Rosenbaum
(74) *Attorney, Agent, or Firm*—Luedeka, Neely & Graham, P.C.

(57) ABSTRACT

A method of crushing material in a crushing plant using multistep crushing to form a crushed product. The crushing plant has a first crushing station, an intermediate storage and a second crushing station. The material is crushed at the first crushing station. The amount of material in the intermediate storage is monitored. The degree of reduction at the first crushing station is changed according to the level of material in the intermediate storage. A device for crushing material has a level monitor arranged to monitor the level of material in the intermediate storage. The level monitor is connected to a control unit which is adapted to change the degree of reduction at least at the first of the crushing stations if the level of material in the intermediate storage increases or decreases.

15 Claims, 3 Drawing Sheets

METHOD AND DEVICE FOR CRUSHING MATERIAL IN A CRUSHING PLANT USING MULTISTEP CRUSHING

This application is a continuation of PCT application PCT/SE00/01231, filed on Jun. 14, 2000, which claims priority to Swedish application no. 9902223-8, filed on Jun. 14, 1999.

FIELD OF THE INVENTION

The present invention relates to a method and a device for crushing of material in a crushing plant having multiple crushing stations.

Methods and devices of the types stated above have been used for a long time to optimise crushing in crushing plants. In crushing plants, such as in mines and ballast plants, use is made of plurality of crushing steps to obtain a desired degree of reduction of the crushed material. The primary crushing step usually is a jaw crusher or a spindle crusher and can be supplied with a cubic meter large blocks of material. Secondary, tertiary and quaternary crushing steps usually comprise cone crushers but can also be impact breakers or mill grinders, and perform crushing of finer materials. The number of crushing steps varies according to the desired reduction of material, the so-called degree of reduction, and also how difficult it is to crush the material. In each crushing step, a plurality of crushers of varying size can be arranged. An important functional consideration when operating crushing plants is that the different crushing steps are balanced, i.e. that the crushers are subjected to a uniform load in the different crushing steps. It is of great economic importance that the crushing plants are operated without unnecessary stoppages.

When installing a crushing plant, the manufacturer of the crusher usually performs a dimensioning of equipment, such as crushers, screens, feeders and conveyors, to obtain a uniform load in the plant. During operation of the plant, variations in the production capacity, however, will arise, inter alia owing to wear on equipment and variations in the properties of the crushed material. When imbalance between two different crushing steps in the crushing plant occurs, it has been solved by turning off the crushing in one crushing step or by alternating the crushing in the different crushing steps. This has resulted in great losses of capacity of the plant and, consequently, reduced efficiency. Moreover, the uneven operation of the crushers in the different crushing steps has caused uneven wear between the different crushing steps. This has in turn resulted in more service occasions, which has caused a great consumption of time and great expenses for repair and maintenance work.

Another way of balancing crushing capacities in two subsequent crushing steps using gyratory crushers has been to change the eccentric motion of the different crushers, also referred to as stroke. By changing the stroke in a crusher, there arises a greater or smaller difference between the maximum and the minimum crushing gap in the crushing chamber of the crusher. The crushing gap is the distance between the crushing surfaces in the crushing chamber where the crushing is carried out. In case of a larger stroke, an increase in the capacity of letting through crushed material arises in the crusher, and in case of a smaller stroke a corresponding decrease arises. In this manner, one has roughly tried to balance the flow in crushing plants. Unfortunately, such adjustments of the stroke are time-consuming since the crusher must be dismantled to enable a change of the setting of the eccentric bushing in the crusher.

Therefore, the stroke in the crushers is rarely changed although imbalance has occurred between different crushing steps. Instead the operator usually stops the supply of material to the crushers in the different crushing steps when imbalance arises between the crushing steps.

A further way of adjusting the capacity of letting through material in certain crushers is to change the smallest crushing gap, Closed Side Setting (CSS). This can be carried out, for example, by changing the distance between the crushing surfaces (inner and outer shell) in the crushing chamber. There are crushers in which the gap is changed by raising or lowering the outer shell of the crusher. This is achieved by turning the upper part of the crusher, which according to requirements of manufacture is allowed to take place only once an hour. Other crushers are available, in which the gap is changed by hydraulically raising or lowering the inner shell of the crusher. As a rule, the crushers are operated with a gap which results in a desired crushed product, such as maximum reduction or optimum grain form. By grain form is meant the degree of cubic form of the material.

In traditional crushing, the crushers in each crushing step are operated with a suitable stroke and gap. The different crushing steps in the crushing plant are adapted to the initial circumstances. However, since there are considerable differences in the properties of material during crushing and the outcome varies as crushing surfaces are being worn, imbalance arises in the plant. When the intermediate storage between two crushing steps has become too large or too small, the crushing in one of the crushing steps has been turned off. When a normal level of material in the intermediate storage has then been achieved, the crushing steps are again started and operated simultaneously. Level monitors are used to monitor the level of material in material storages or material compartments before the different crushing steps. Signals from the level monitors are transmitted to control units which control the supply of material to the crushing steps.

Since crushers in different crushing steps can have capacities of up to several hundred tonnes/h, every small increase of the crushing capacity causes an increased production capacity.

SUMMARY OF THE INVENTION

An object of the present invention is to provide a method and a device for improving the crushing of material in a crushing plant which comprises at least two crushing stations.

A further object of the present invention is to obviate the above problems in prior-art technique.

One more object of the present invention is to provide an improved crushed product from crushing stations in crushing plants.

These and other objects that will be evident from the following description are achieved by a method and a device of the type described hereinafter.

Crushing is carried out by crushing material at the first crushing station and conveying at least those parts of the crushed product whose size exceeds the stipulated maximum grain size to the intermediate storage. The remaining parts of the crushed product are conveyed to a material outlet. The amount of material in the intermediate storage is monitored and the degree of reduction at the first crushing station is increased if the level of material in the intermediate storage exceeds a first predetermined level. If the level of material in the intermediate storage falls below a second predetermined level, the degree of reduction of the first crushing station is decreased.

The crushing means, for example, that the first crushing station must work harder with an increased degree of reduction and a lower capacity when the second crushing station does not manage to keep up. This results in a smaller number of stoppages in the crushing plant, which leads to an improved crushing economy. The crushing work of the crushing stations can be finely adjusted and thus be adapted to variations in material and wear based on the level of material in the intermediate storage.

By monitoring the level of material in the intermediate storage by means of a level monitor, the plant and, thus, the operation of the first crushing station can advantageously be automated. The degree of reduction of the first crusher will then be controlled with improved accuracy in respect of changes in material properties and the like, which causes an increased crushing efficiency.

Preferably the degree of reduction at the second crushing station is decreased if the level of material in the intermediate layer exceeds a first predetermined level. Correspondingly, the degree of reduction at the second crushing station is increased if the level of material in the intermediate storage falls below a second predetermined level. As a result, each crushing station will be utilised maximally in cooperation with the preceding or subsequent crushing station. The interplay between the different crushing stations makes it possible for the crushing stations to crush material essentially continuously without interruption, thus causing a greater utilisation of the capacity of the crushing stations.

When, for example, the level of material in the intermediate storage is too high, the degree of reduction at the first crushing station is increased. Then the total capacity through the first crushing station decreases while the amount of fine material of the crushed product, which passes the intermediate storage and the second crushing station to the material outlet, increases. With a large amount of fine material produced at the first crushing station, a decrease of the degree of reduction at the second crushing station can be made without a significant change in the composition of material in the material outlet. By changing the degree of reduction at the two crushing stations simultaneously, the level of material in the intermediate storage will be quickly restored.

Moreover, the change of the degree of reduction in the first crushing step preferably occurs at intervals of up to about 10 min, preferably up to about 5 min and most advantageously about 1 min. Corresponding changes can also be made for the second crushing step. This means that the degree of reduction of the crushing stations can be balanced continuously after changes in the levels that arise in the intermediate storage. This also results in the balance between the two crushing stations being rapidly restored in case of imbalance.

According to a preferred embodiment, a change in the degree of reduction at the first crushing station is achieved by changing the minimum crushing gap. Since the change of the gap can be carried out without a crusher at the first crushing station needing be dismantled, work and time will be saved.

The degree of reduction can advantageously be changed in operation to eliminate unnecessary stoppages. By operation is meant, for example, that the crushing station carries out crushing work as the change in the degree of reduction is being made. Alternatively, the crusher operates without supply of material as the change in the degree of reduction is being made.

The device for crushing material in a crushing plant has, according to a preferred embodiment, a level monitor for monitoring the level of material in the intermediate storage and a control unit for controlling the degree of reduction at two crushing stations arranged on each side of the intermediate storage. The intermediate storage is preferably monitored continuously. This makes it possible to improve the utilisation of crushers in the different crushing steps and obtain a more even operation in the crushing plant.

BRIEF DESCRIPTION OF THE DRAWINGS

The invention will now be described in more detail by way of an embodiment with reference to the accompanying drawings.

DESCRIPTION OF PREFERRED EMBODIMENTS

Figure 1:
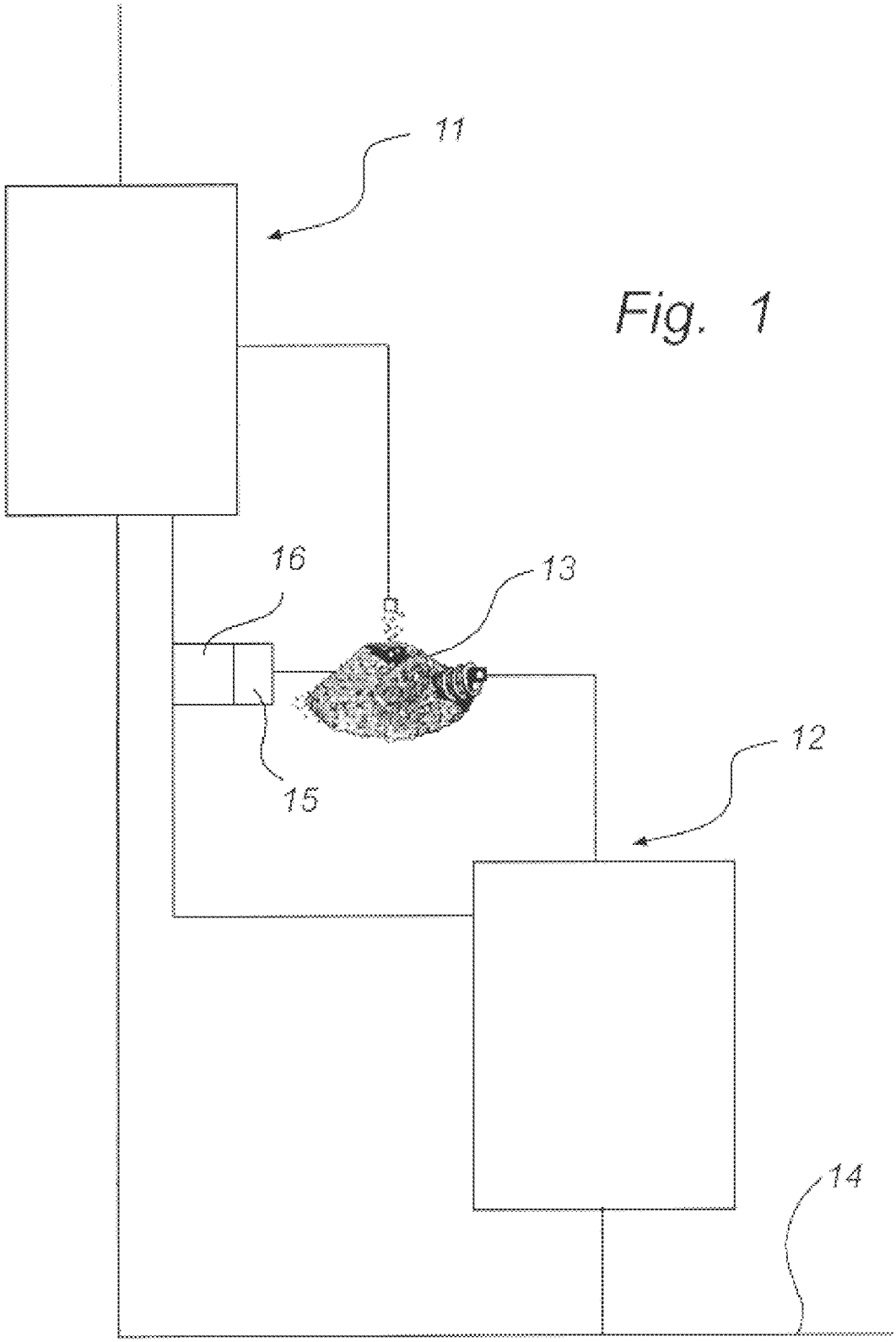
FIG. 1 is a schematic flow chart and shows a first and a second crushing station.
Figure 2:
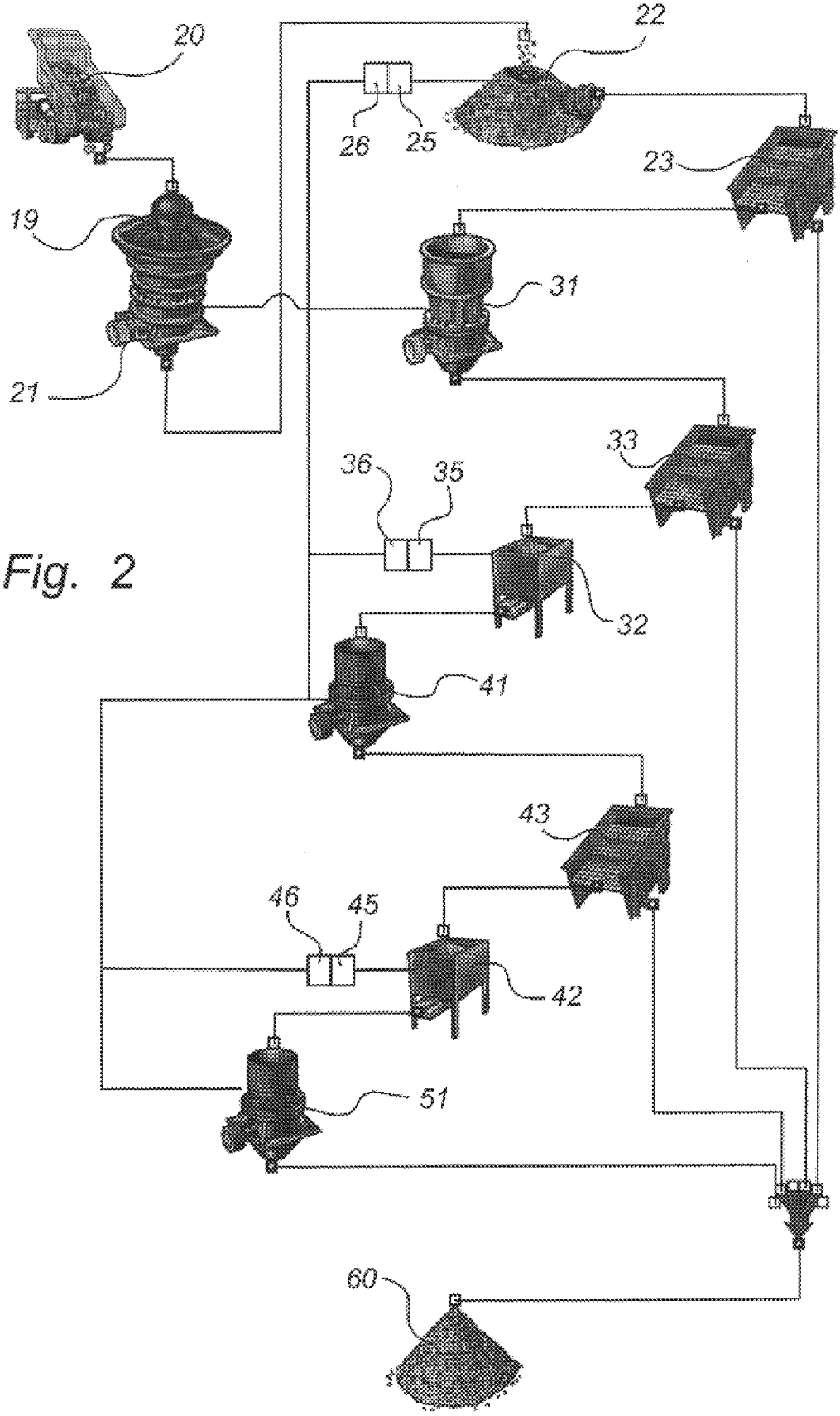
FIG. 2 is a schematic flow chart and shows a simplified crushing plant with four crushing steps.

With reference to FIGS. 1 and 2, a preferred embodiment of the invention will now be described. FIG. 1 shows part of a crushing plant, which has a first crushing station 11 and a second crushing station 12 arranged on each side of an intermediate storage 13. By intermediate storage 13 is meant, for example, material store and feeding pockets. Each crushing station 11, 12 comprises a crushing step to provide a reduction of the material to be crushed. Each crushing step has one or more crushers installed in a single or a plurality of parallel crusher lines. The crushing stations 11, 12 may also comprise some kind of screen or some other suitable material-separating device.

The two crushing stations 11, 12 which are arranged in series can be installed in a crushing plant in which two subsequent crushing steps are arranged. This means that the balancing of crushing stations 11, 12 can be made between, for instance, the first and second, the second and third, or the third and fourth crushing step in the crushing plant. The balancing could also be carried out between a plurality of different crushing steps simultaneously in order to balance different parts of the crushing plant.

In connection with crushing in the crushing plant, a material, such as rocks, ore, construction waste or some other crushable material, will be supplied to the first crushing station 11. The crushed product from the first crushing station 11 is then distributed so that at least those parts of the crushed product whose grain size exceeds a stipulated maximum grain size are conveyed to the intermediate storage 13. By stipulated grain size is meant the size of material that is desirable in a material outlet 14 after the second crushing station 12. By material outlet 14 is meant conveyors or material stores after the second crushing station 12.

The material in the intermediate storage 13 is then conveyed to the second crushing station 12 to be further reduced by crushing. The crushed product from the second crushing station 12 is then conveyed to the material outlet 14 and further in the plant for additional processing.

Figure 3:
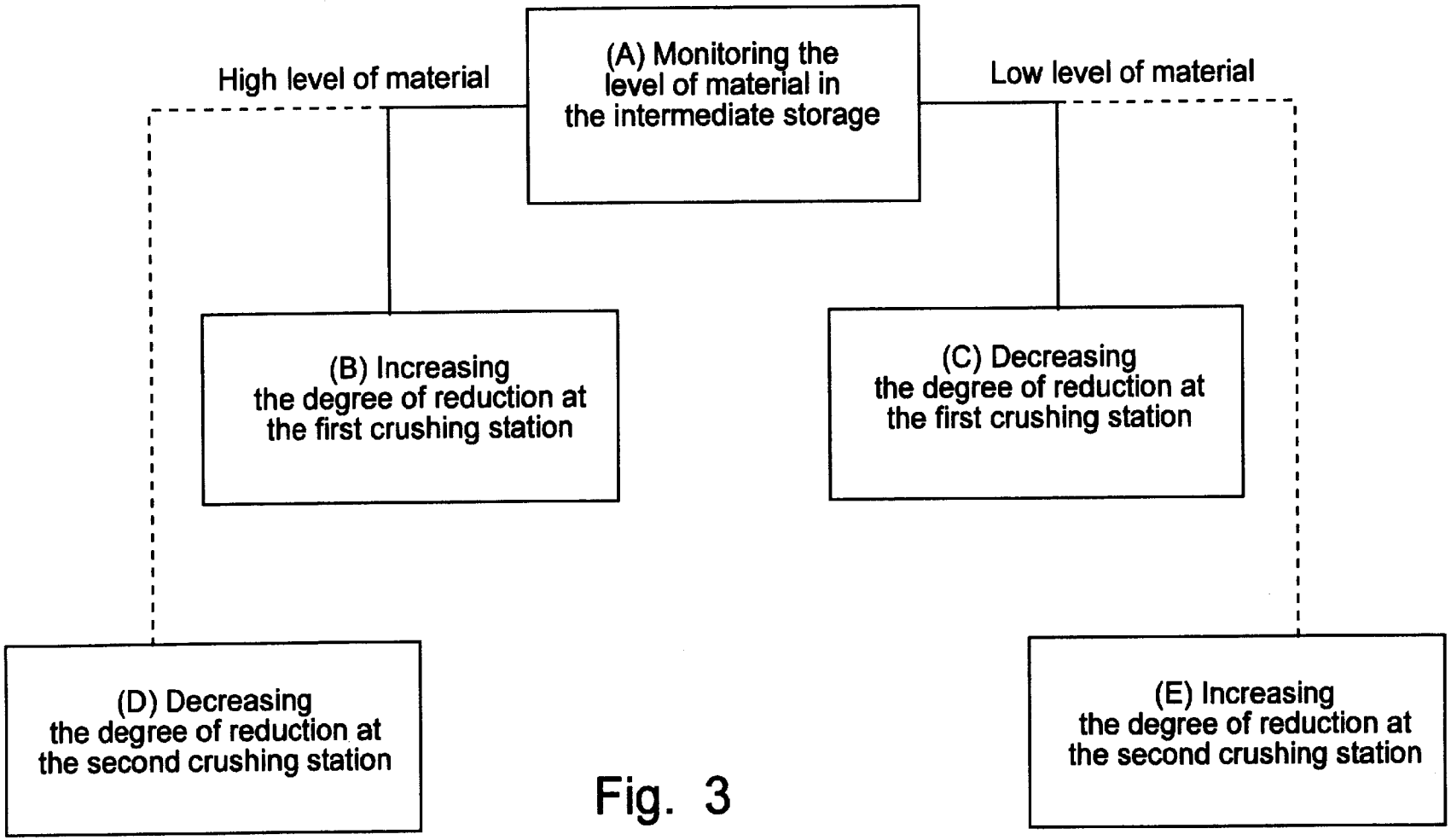
FIG. 3 is a schematic flow chart and shows the steps in the strategy of controlling.

FIG. 3 shows steps A–E in the strategy of controlling, i.e. how the degree of reduction at the crushing stations 11, 12 is controlled depending on the level of material in the intermediate storage 13. It goes without saying that the steps in the strategy of controlling are repeated with a desirable frequency to obtain and maintain a balance between the crushing stations 11, 12. The preferred embodiment, in which the first crushing station 11 is controlled, is indicated by full lines. A further preferred embodiment, in which also the second crushing station 12 is controlled, is indicated by full and dashed lines.

By monitoring the level of material in the intermediate storage 13, see A in FIG. 3, and controlling the degree of reduction at the crushing stations 11, 12, a balancing between these crushing stations 11, 12 is achieved. When the level of material in the intermediate storage 13 exceeds a first predetermined level, the degree of reduction at the first crushing station 11 is increased, see B in FIG. 3. Thus, a greater reduction of the material is carried out and the crushing capacity is decreased at the first crushing station 11. In the same way, the degree of reduction at the first crushing station 11 is decreased as the level of material in the intermediate storage 13 falls below a second predetermined level, see C in FIG. 3. Then a larger amount of material having a slightly coarser grain size is supplied to the second crushing station 12. Thus, the second crushing station 12 must work harder when the level of material in the intermediate storage 13 is low.

When the level of material in the intermediate storage 13 increases and the degree of reduction at the first crushing station 11 is increased, it is also possible to accelerate the balancing between the first and the second crushing station 11, 12 by decreasing the degree of reduction at the second crushing station 12, see D in FIG. 3. Correspondingly, the degree of reduction at the second crushing station 12 can be increased when the degree of reduction at the first crushing station 11 is decreased, see E in FIG. 3. A person skilled in the art understands that, as the degree of reduction in a crusher is decreased, this also results in an increase of the capacity (tonne/h) through the crusher. The reversed conditions apply as the degree of reduction is increased, viz. that the capacity of the crusher (tonne/h) decreases.

In the preferred embodiment, gyratory crushers, such as cone or spindle crushers, are arranged at the first and the second crushing station 11, 12. At least one level monitor 15 is arranged in the intermediate storage 13. The level monitor 15 transmits signals to a control unit 16, which is connected to the crushing stations 11, 12, as the level of material in the intermediate storage 13 exceeds the first predetermined level or falls below the second predetermined level. Of course, the first and the second predetermined level in the intermediate storage can be the same level or define a range. A person skilled in the art understands what level monitors are suitable for use.

With a view to regularly changing the degree of reduction at the desired crushing stations 11, 12, the minimum crushing gaps, Closed Side Setting (CSS), of the crushers arranged therein are adjusted in the preferred embodiment. The gap is changed by changing the distance between the crushing surfaces in the crushing chambers of the crushers at each crushing station 11, 12. This takes place preferably by raising or lowering an inner shell 19 in the crushing chamber. The raising or lowering of the inner shell 19 is carried out hydraulically. This allows an essentially continuous adjustment of the gap (CSS). Alternatively, the outer shell in the crushing chamber can be adjusted by turning the upper part of the crusher in order to change the gap (CSS).

It is an obvious advantage that it is possible to change the degree of reduction without dismantling the crusher. Moreover, it is advantageous that the degree of reduction can be changed in operation. For example, the change of the gap can be made, during crushing. In the same manner, the change of the degree of reduction can be made when the crusher is idling.

It is advantageous to remove the fine material from the crushed product of the first crushing station since the subsequent crushing station 12 can then operate at a high crushing pressure with a smaller risk of packing in the crushing chamber. The separation of the crushed product is advantageously made by means of a screen or a separating grid. The fine material passes the intermediate storage by means of conveyors directly to the material outlet 14.

The control unit 16 in the preferred embodiment controls the gaps in the gyratory crushers according to the level of material in the intermediate storage 13. The control unit 16 may consist of a separate control unit 16, such as the SVEDALA ASR Plus System, for each crusher at the crushing station 11, 12 or consist of a control unit 16 for controlling a plurality of crushers at one or more crushing stations 11, 12. Signals are transmitted from the level monitor 15 to the control unit 16 at an interval of less than about 1 min to obtain continuous monitoring of the level of material in the intermediate storage 13. The control unit 16 thus controls the crushers continuously based on the level of material in the intermediate storage 13.

The change in the degree of reduction at the first and/or the second crushing station 11, 12 occurs at intervals of up to about 10 min, preferably up to about 5 min or most advantageously about 1 min. To prevent the crusher and other equipment from being damaged during crushing, the control unit 16 can also control the parameters of the crusher, such as power (kW) and pressure (MPa).

For the purpose of explanation, FIG. 2 shows a simplified flow chart for a crushing plant 1 which has four crushing steps 21, 31, 41, 51. The material to be crushed is supplied to the plant from a material supply 20, such as a loader. The separation of the various crushed products from the crushing steps is carried out, for example, by means of a screen 23, 33, 43 arranged after each crushing step. At least that part of the crushed product which has a grain size larger than a predetermined maximum size for each crushing step, is conveyed to an intermediate storage 22, 32, 42. In the intermediate storages 22, 32, 42 the level of material is monitored by means of level monitors 25, 25, 45. The degree of reduction in the various crushing steps is controlled by the control units 26, 36, 46 which receive signals from the level monitors 25, 35, 45 according to the level of material in the intermediate storages 22, 32, 42. The amount of fine material from the screens 23, 33, 43, which falls below the predetermined maximum grain size, is conveyed to a material outlet 60. The material in the intermediate storages 22, 32, 42 is conveyed to a subsequent crushing step 31, 41, 51 for additional reduction. It should be mentioned that this is a simplified flow chart in which parallel crusher lines have been omitted for the purpose of elucidation. Moreover, no closed circuits for recrushing, feeders and conveyors etc are shown. The application of the balancing by continuously monitoring the level of material in the intermediate storages can be made on any two subsequent crushing steps in the plant.

It will be appreciated that a large number of modifications of the above-described embodiment of the invention are feasible within the scope of the invention as defined by the appended claims. For example, as described above the crushers at the crushing stations could be impact grinders or hammer mills. Then the degree of reduction would be changed in the crushers by changing the speed of a rotor or rotor shaft. These changes could also be made without dismantling the crushers, which results in the previously discussed advantages. For impact grinders, it would be of interest to let essentially all the material pass through the crushing stations 11, 12 since the desired composition of the crushed product in certain cases is obtained with a large amount of fine material in the material to be supplied.

What is claimed is:

1. A method of crushing material in a crushing plant using multistep crushing to produce a crushed product having a stipulated maximum grain size comprising the steps of:

providing a crushing plant having a first crushing station, an intermediate storage for receiving at least a portion of the crushed product from the first crushing station, and a second crushing station for receiving material from the intermediate storage, crushing material at the first crushing station, conveying from the first crushing station to the intermediate storage at least that portion of the crushed product whose size exceeds the stipulated maximum grain size and conveying at least a portion of any of the balance of the crushed product to a material outlet, monitoring the amount of material in the intermediate storage, increasing the degree of reduction of the first crushing station and, thus, reducing its capacity if the amount of material in the intermediate storage exceeds a first predetermined amount, and decreasing the degree of reduction of the first crushing station and, thus, increasing its capacity if the amount of material in the intermediate storage falls below a second predetermined amount.

2. A method as claimed in claim 1, further comprising the steps of monitoring the amount of material in the intermediate storage by means of a monitor, transmitting a first signal from the monitor to a control unit for controlling the first crushing station if the amount of material in the intermediate storage exceeds the first predetermined amount, for said increase of the degree of reduction, and transmitting a second signal from the monitor to the control unit for controlling the first crushing station if the amount of material in the intermediate storage falls below the second predetermined amount, for said decrease of the degree of reduction.

3. A method as claimed in claim 2 wherein the signals from the monitor are transmitted to the control unit at intervals of less than about 1 min.

4. A method as claimed in claim 1 further comprising the steps of crushing material at the second crushing station to reduce the size of the material received from the intermediate storage and produce a further crushed product, decreasing the degree of reduction of the second crushing station if the amount of material in the intermediate storage exceeds the first predetermined amount, increasing the degree of reduction of the second crushing station if the amount of material in the intermediate storage falls below the second predetermined level, and discharging further crushed product form the second crushing station.

5. A method as claimed in claim 4, wherein the degree of reduction of the second crushing station is changed at intervals of up to about 10 min.

6. A method as claimed in claim 4, further comprising the steps of monitoring the level of material in the intermediate storage by means of a monitor, transmitting a first signal from the monitor to a control unit for controlling the second crushing station if the amount of material in the intermediate storage exceeds the first predetermined amount, for said decrease of the degree of reduction, and transmitting a second signal from the monitor to the control unit for controlling the second crushing station if the amount of material in the intermediate storage falls below the second predetermined amount, for said increase of the degree of reduction.

7. A method as claimed in claim 1, wherein the degree of reduction of the first crushing station is changed at intervals of up to about 10 min.

8. A method as claimed in claim 1, further comprising the step of changing a minimum crushing gap at the first crushing station so as to change the degree of reduction.

9. A method as claimed in claim 1, wherein the first crushing station includes a gyratory crusher and including the step of changing a minimum crushing gap at the first crushing station by hydraulically raising or lowering an inner shell in the crusher so as to change the degree of reduction.

10. A method as claimed in claim 1 further comprising the step of repeating the change of the degree of reduction in operation.

11. A device for crushing material in a crushing plant using multistep crushing to form a crushed product comprising a first and a second crushing station, a control unit for controlling the degree of reduction at the crushing stations, at least one monitor and an intermediate storage, the intermediate storage being adapted to receive at least parts of a crushed product from the first crushing station and feed the same to the second crushing station wherein the monitor is adapted to monitor an amount of material in the intermediate storage and is connected to the control unit, and wherein the control unit is adapted to change the degree of reduction of at least the first crushing station if the amount of material in the intermediate storage increases or decreases.

12. A device as claimed in claim 11, wherein the control unit is adapted to increase or decrease the degree of reduction of at least the first crushing station while the first crushing station is in operation.

13. A device as claimed in claim 11 wherein the control unit is adapted to increase or decrease a crushing gap at least at the first crushing station so as to decrease or increase the degree of reduction.

14. A method of crushing material in a crushing plant using multistep crushing to produce a crushed product having a stipulated maximum grain size comprising the steps of:

providing a crushing plant having a first crushing station, an intermediate storage for receiving at least a portion of the crushed product from the first crushing station, and a second crushing station for receiving material from the intermediate storage, crushing material at the first crushing station to reduce the size of the material and produce a crushed product, conveying to the intermediate storage at least that portion of the crushed product whose size exceeds the stipu lated maximum grain size and conveying any balance of the crushed product to a material outlet, monitoring the amount of material in the intermediate storage, and increasing the degree of reduction of the first crushing station and, thus, reducing its capacity if the amount of material in the intermediate storage exceeds a first predetermined amount.

15. A method of crushing material in a crushing plant using multistep crushing to produce a crushed product having a stipulated maximum grain size comprising the steps of:

providing a crushing plant having a first crushing station, an intermediate storage for receiving at least a portion of the crushed product from the first crushing station, and a second crushing station for receiving material from the intermediate storage, crushing material at the first crushing station to reduce the size of the material and produce a crushed product, conveying to the intermediate storage at least that portion of the crushed product whose size exceeds the stipulated maximum grain size and conveying any balance of the crushed product to a material outlet, monitoring the amount of material in the intermediate storage, and decreasing the degree of reduction of the first crushing station and, thus, increasing its capacity if the amount of material in the intermediate storage falls below a predetermined amount.

* * * * *

UNITED STATES PATENT AND TRADEMARK OFFICE

CERTIFICATE OF CORRECTION

PATENT NO. : 6,595,443 B2
DATED : July 22, 2003
INVENTOR(S) : Christian Ottergren It is certified that error appears in the above-identified patent and that said Letters Patent is hereby corrected as shown below:

Column 8,
Line 67, a hyphen is missing after "stipu".

Signed and Sealed this

Second Day of March, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,595,443 B2
DATED : July 22, 2003
INVENTOR(S) : Christian Ottegren It is certified that error appears in the above-identified patent and that said Letters Patent is hereby corrected as shown below:

Column 8,
Line 67, a hyphen is missing after “stipu”.

Signed and Sealed this

Twenty-first Day of September, 2004

JON W. DUDAS
*Director of the United States Patent and Trademark Office*

UNITED STATES PATENT AND TRADEMARK OFFICE

CERTIFICATE OF CORRECTION

PATENT NO. : 6,595,443 B2
DATED : July 22, 2003
INVENTOR(S) : Christian Ottergren It is certified that error appears in the above-identified patent and that said Letters Patent is hereby corrected as shown below:

Title page,
Item [56], References Cited, U.S. PATENT DOCUMENTS, please add:
-- 4,402,462 9/6/1983 Ludger Lohnherr --

Signed and Sealed this

Fifth Day of April, 2005

JON W. DUDAS
*Director of the United States Patent and Trademark Office*